US008821746B2

(12) United States Patent
Kojima

(10) Patent No.: US 8,821,746 B2
(45) Date of Patent: Sep. 2, 2014

(54) FABRICATION METHOD OF SEMICONDUCTOR DEVICE AND CHEMICAL MECHANICAL POLISHING APPARATUS

(75) Inventor: Ryota Kojima, Yokohama (JP)

(73) Assignee: Fujitsu Semiconductor Limited, Yokohama (JP)

( * ) Notice: Subject to any disclaimer, the term of this patent is extended or adjusted under 35 U.S.C. 154(b) by 0 days.

(21) Appl. No.: 13/481,046

(22) Filed: May 25, 2012

(65) Prior Publication Data

US 2012/0302064 A1 Nov. 29, 2012

(30) Foreign Application Priority Data

May 27, 2011 (JP) ..... 2011-119641

(51) Int. Cl.

| | |
|---|---|
| ***C03C 15/00*** | (2006.01) |
| ***B24B 53/017*** | (2012.01) |
| ***B24B 49/18*** | (2006.01) |
| ***B24B 37/04*** | (2012.01) |
| ***B24B 49/16*** | (2006.01) |
| ***B24B 37/10*** | (2012.01) |
| ***B24B 37/005*** | (2012.01) |

(52) U.S. Cl.

CPC ..... *B24B 53/017* (2013.01); *B24B 49/18* (2013.01); *B24B 37/042* (2013.01); *B24B 49/16* (2013.01); *B24B 37/107* (2013.01); *B24B 37/005* (2013.01)

USPC ..... 216/84; 216/37; 216/67; 438/689; 438/690; 438/691; 438/692

(58) Field of Classification Search

USPC ..... 216/84, 37, 67; 438/689–692

See application file for complete search history.

(56) References Cited

U.S. PATENT DOCUMENTS

| | | | | |
|---|---|---|---|---|
| 5,738,574 | A * | 4/1998 | Tolles et al. | 451/288 |
| 5,743,784 | A * | 4/1998 | Birang et al. | 451/21 |
| 8,096,852 | B2 * | 1/2012 | Deshpande et al. | 451/5 |

FOREIGN PATENT DOCUMENTS

JP 2005-022028 A 1/2005

* cited by examiner

*Primary Examiner* — Lan Vinh
*Assistant Examiner* — Maki Angadi
(74) *Attorney, Agent, or Firm* — Westerman, Hattori, Daniels & Adrian, LLP

(57) ABSTRACT

A method of fabricating a semiconductor device includes dressing a surface of a polishing pad with a conditioning disk held by an arm while rotating a platen that holds the polishing pad in a chemical mechanical polishing apparatus, wherein the dressing is performed by pressing the conditioning disk to the polishing pad, and rotating the arm around a rotational axis of the arm thereby to move the conditioning disk substantially along a radius direction of the platen between a center part and a circumferential part of the platen, and wherein torque N applied to the arm is measured at plural positions of the conditioning disk along the substantial radius direction during the dressing, and it is determined whether maintenance to the arm is necessary in accordance with an average value <N> of the measured torques N and a fluctuation range Y of the measured torques N.

6 Claims, 10 Drawing Sheets

FABRICATION METHOD OF SEMICONDUCTOR DEVICE AND CHEMICAL MECHANICAL POLISHING APPARATUS

CROSS REFERENCE TO RELATED APPLICATIONS

This application is based upon and claims the benefit of priority of the prior Japanese Patent Application No. 2011-119641 filed on May 27, 2011, the entire contents of which are incorporated herein by references.

FIELD

Embodiment(s) discussed herein is (are) related to a fabrication method of a semiconductor device and a chemical mechanical polishing apparatus.

BACKGROUND

A chemical mechanical polishing is now widely used in order to remove a metal film, an insulating film, or a semiconductor film, thereby to form a wiring pattern or a planarized surface in fabrication of semiconductor devices or other electric devices.

Generally, a chemical mechanical polishing is carried out using a chemical mechanical polishing apparatus provided with a platen that holds a polishing pad and is rotatable at a predetermined rotational speed. Slurry is applied to the platen. An object to be polished (referred to as a wafer, hereinafter) such as a semiconductor wafer is held on a polishing head, rotated at a predetermined rotational speed, and is pressed at a predetermined pressure onto the polishing pad that is rotating along with the platen. In such a manner, the wafer is polished due to a mechanical and chemical polishing effect of the slurry. In the chemical mechanical polishing for the semiconductor device, a bubble resin film or a bubble-less resin film, which may have various degrees of hardness, is used as the polishing pad. As the slurry, a dispersive liquid may be used that is formed of abrasive grains including particles formed of, for example, silica ($SiO_2$), alumina ($Al_2O_3$), and cerium dioxide (ceria, $CeO_2$), water, and a solvent whose pH is adjusted, depending on a type of wafer. The slurry is dispensed at a predetermined rate onto the polishing pad during polishing.

In such a chemical mechanical polishing apparatus, a surface of the polishing pad is scraped in advance in many cased, thereby obtaining a rough surface, in order for the slurry to be retained on the polishing pad. Such scraping is called "dressing" or "conditioning". The dressing is carried out by using a rotatable conditioning disk where diamond abrasive grains are buried. Specifically, the conditioning disk is rotated at a predetermined rotational speed and pressed at a predetermined pressure onto the polishing pad on the platen that is rotated at a predetermined rotational speed, so that the surface of the polishing pad is scraped by the diamond abrasive grains.

The slurry (the particles, water, and the solvent) can be stably retained on the rough surface of the polishing pad so scraped, and applied to the surface of the wafer to be polished. In addition, the rough surface of the polishing pad can retain polishing residues that are caused by polishing the surface of the wafer, so that scratches are prevented from being caused on the polished surface. The surface of the polishing pad is scraped by the conditioning disk thereby restoring the rough surface every time after one or several wafer(s) is polished.

Because such dressing needs to be carried with respect to an entire surface of the polishing pad, the conditioning disk is usually arranged near the platen and provided at a distal end of an arm that is pivotably supported by a bearing, so that the dressing is applied to the entire surface of the polishing pad by rotating the arm around the bearing.

Incidentally, when the chemical mechanical polishing is carried out for a relatively long period of time with respect to lots of wafers in the chemical mechanical polishing apparatus, the bearing of the arm may be worn off, which causes unwanted vibrations of the arm when the arm rotates. Once such vibrations take place, it becomes difficult to press the conditioning disk onto the polishing pad at a predetermined pressure, so that the dressing of the polishing pad cannot be desirably carried out.

When a reduction of the polishing speed is decreased or the scratches are caused, such problems are solved by changing the polishing pads and/or the slurries, however, the vibration-related problem cannot be solved in the same manner.

SUMMARY

According to an aspect of the present invention, a method of fabricating a semiconductor device includes dressing a surface of a polishing pad with a conditioning disk held by an arm while rotating a platen that holds the polishing pad in a chemical mechanical polishing apparatus, wherein the dressing is performed by pressing the conditioning disk to the polishing pad, and rotating the arm around a rotational axis of the arm thereby to move the conditioning disk substantially along a radius direction of the platen between a center part and a circumferential part of the platen, and wherein torque N applied to the arm is measured at plural positions of the conditioning disk along the substantial radius direction during the dressing, and it is determined whether maintenance to the arm is necessary in accordance with an average value <N> of the measured torques N and a fluctuation range Y of the measured torques N.

According to another aspect of the present invention, a chemical mechanical polishing apparatus includes a platen that is rotatable and holds a polishing pad; a slurry supplying nozzle that supplies slurry to a polishing pad on the platen; a polishing head that presses a wafer to be polished to the polishing pad on the platen and rotates the wafer to be polished; a conditioning disk that is allowed to be pressed on the surface of the polishing pad and rotated, thereby dressing the surface of the polishing pad; an arm that holds the conditioning disk and scans the held conditioning disk on the surface of the polishing pad; a torque measurement part that measures torque applied to the arm in plural positions of the conditioning disk along a radius direction of the platen; and a data processing part that obtains an average value <N> of the torque by averaging the torques measured at the plural positions by the torque measurement part and a fluctuation range Y of the measured torques N, and determines whether maintenance to the arm is necessary in accordance with the average value <N> and the fluctuation range Y.

The object and advantages of the invention will be realized and attained by means of the elements and combinations particularly pointed out in the claims.

It is to be understood that both the foregoing general description and the following detailed description are exemplary and explanatory and are not restrictive to the invention as claimed.

DESCRIPTION OF EMBODIMENTS

The embodiments are now described with reference to the accompanying drawings. The same elements or components are denoted by the same symbols, and redundant explanation for them is omitted.

Figure 1:
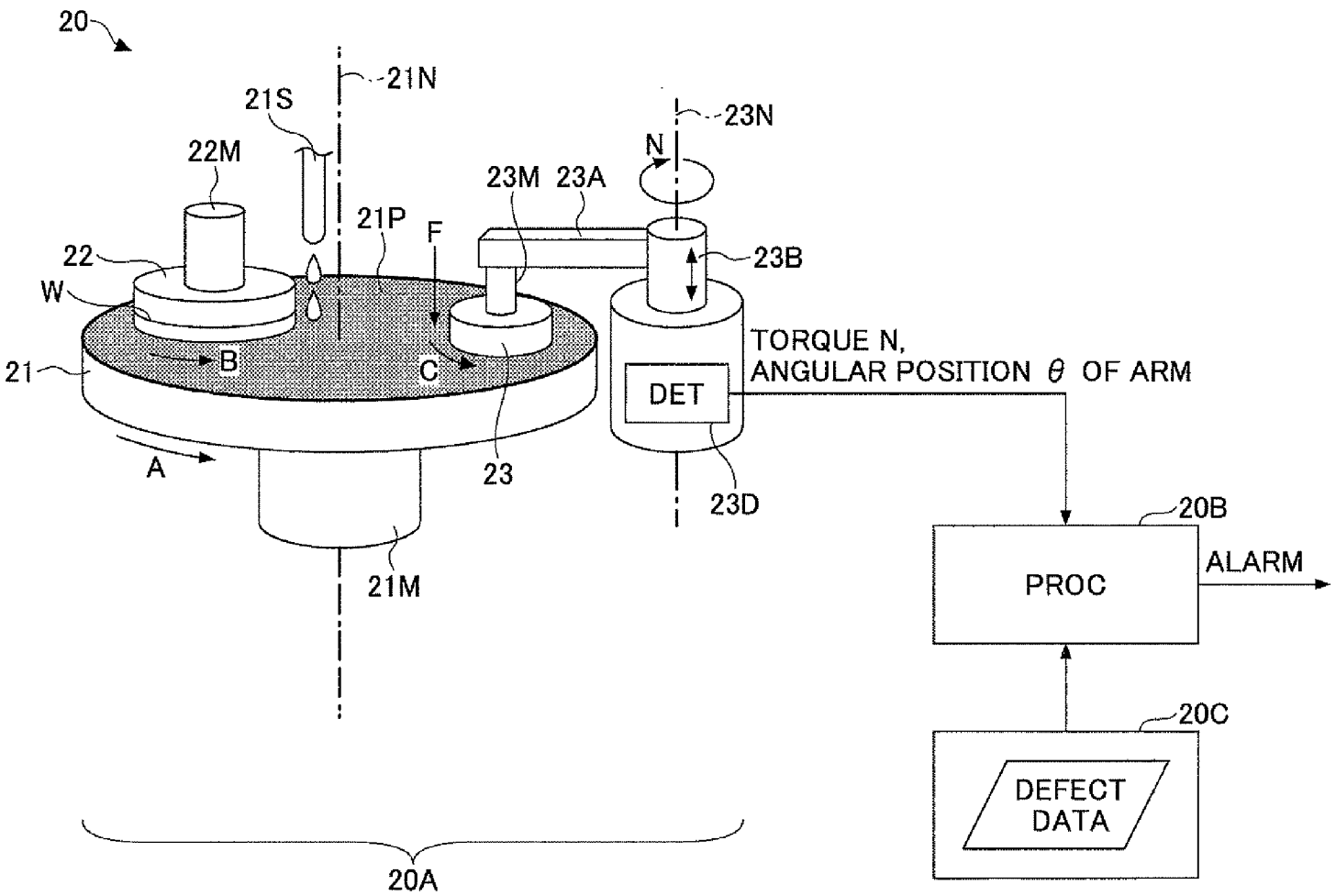
FIG. 1 is a block diagram illustrating a chemical mechanical polishing system including a chemical mechanical polishing apparatus according to an embodiment of the present invention.

FIG. 1 illustrates an entire configuration of a chemical mechanical polishing system 20 according to an embodiment of the present invention.

Referring to FIG. 1, the chemical mechanical polishing system 20 includes a chemical mechanical polishing apparatus 20A, a date processing apparatus 20B, and a defect detecting apparatus 20C. The chemical mechanical polishing apparatus 20A is provided with a platen 21 that is rotated at a predetermined rotational speed in a direction illustrated by an arrow A around a rotational axis 21N by a motor 21M. A polishing pad 21P is held on the platen 21 and rotated at a predetermined speed along with the platen 21.

Above the polishing pad 21P, a dispense nozzle 21S is arranged to dispense slurry onto the polishing pad 21P. In addition, a polishing head 22 is arranged above the polishing pad 21P, and holds a wafer W such as a semiconductor wafer on the bottom surface of the polishing head 22, so that the wafer W is pressed on the polishing pad 21P by the polishing head 22. The polishing pad 21P is rotated around a vertical center axis by a motor 21M. With these configurations, the polishing head 22 presses the wafer W onto the polishing pad 21P while rotating the wafer W along a rotational direction B, in this embodiment.

A conditioning disk 23 is provided on the polishing pad 21P. The conditioning disk 23 is composed of a resin (or metal) disk and diamond abrasive grains embedded on the resin (or metal) disk. The conditioning disk 23 is held at a distal end part of an arm 23A via a motor 23M, and thus can be rotated along a rotational direction C at a predetermined rotational speed while being pressed onto the polishing pad 21P with a predetermined pressure F. The arm 23A includes a driving motor (not illustrated), and a base part of the arm 23A is attached to a bearing part 23B that allows the arm 23A to pivot around a pivotal axis 23N perpendicular to a surface of the platen 21. The bearing part 23B is provided with a torque measurement part 23D that measures torque N that is caused when the arm 23A pivots around the pivotal axis 23N. The torque measurement part 23D includes a stress sensor such as a load cell, a strain gauge, and an AE sensor. Specifically, the torque measurement part 23D measures stress, which is caused in the arm 23A when the platen 21 is rotated along the direction A in FIG. 1, when the conditioning disk 23 is rotated along the direction C, and when the friction between the polishing pad 21P and the conditioning disk 23, by the stress sensor, and obtains the torque N around the pivotal axis 23N together with an angular position θ of the arm 23A in accordance with the measured stress.

Figure 2:
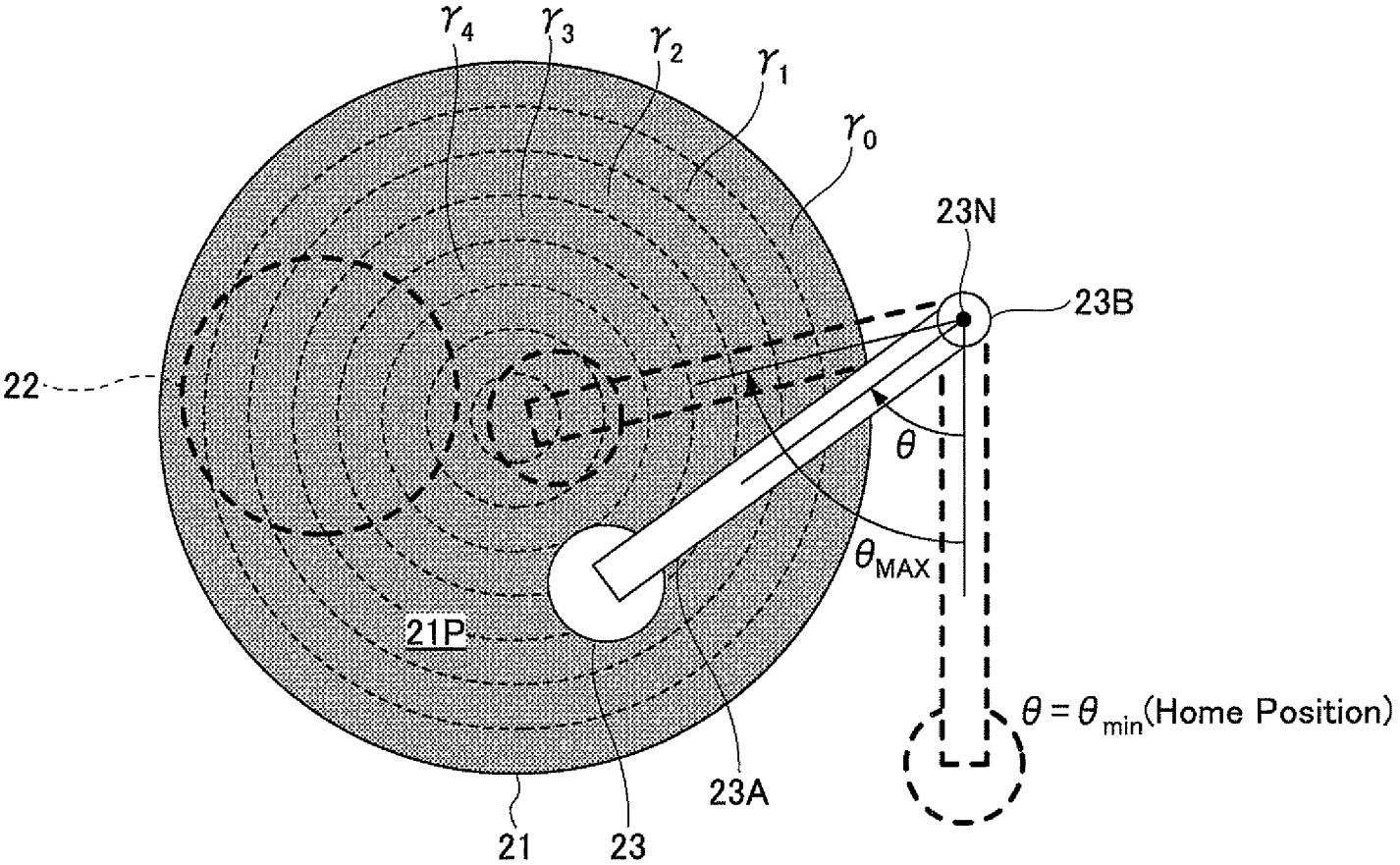
FIG. 2 is a plan view illustrating the chemical mechanical polishing apparatus included in the chemical mechanical polishing system of FIG. 1.

FIG. 2 is a plan view of the platen 21 and the conditioning disk 23 of the chemical mechanical polishing apparatus 20A (FIG. 1).

Referring to FIG. 2, the arm 23A is pivotable around the pivotal axis 23N between a first angular position (θmin: home position) and a second angular position (θMAX). With this, the conditioning disk 23 held by the arm 23A is allowed to contact an entire surface of the polishing pad 21P that is rotated together with the platen 21, while the conditioning disk 23 is outside of the platen 21 and thus does not contact the platen 21 when the arm 23A is at the first angular position. When the arm 23A pivots around the pivotal axis 23N, a position of the conditioning disk 23 on the surface of the polishing pad 21P is changed along a radius direction of the platen 21. As explained later, the surface of the polishing pad 21P is divided into plural sections γ0, γ1, γ2, . . . along the radius direction of the platen 21, and thus the conditioning disk 23 continuously scans the sections γ0, γ1, γ2, . . . in this or the opposite direction along with the pivotal movement of the arm 23A.

An angular position θ of the arm 23A is converted into a distance of the conditioning disk 23 on the platen 21 along the radius direction from the center of the platen 21 in this embodiment (or from the circumference of the platen 21, in other embodiments) by the date processing apparatus 20B in this embodiment.

The bearing part 23B can not only pivot around the pivotal axis 23N but also move upward and downward along the pivotal axis 23N, which makes it possible for the arm 23A to press the conditioning disk 23 onto the polishing pad 21P with a predetermined pressure F.

As such a chemical mechanical polishing apparatus 20A, a chemical mechanical polishing apparatus, for example but not limited to, "Reflection-LK" available from Applied Materials, Inc. (Santa Clara, Calif.) may be used.

The data processing apparatus 20B of the chemical mechanical polishing system 20 receives a value of the torque N and the distance of the arm 23A (i.e., information indicating the distance of the conditioning disk 23 along the radius direction from the center of the platen 21) from the torque measurement part 23D provided in the bearing part 23B; statistically processes in the following manner; and outputs an alarm signal when malfunction is detected based on the process result.

In addition, the defect detecting apparatus 20C includes, for example, a microscope with which a surface of the wafer W, which is polished by the chemical mechanical polishing apparatus 20A, is observed. The defect detecting apparatus 20C conducts an image processing with respect to the observed surface and obtains the number of defects and their distribution, thereby providing the number of defects in the form of a histogram, or a defect map illustrating the defect distribution.

Incidentally, while FIG. 1 seemingly illustrates that the dressing is carried out with respect to the polishing pad 21 by using the conditioning disk 23 at the same time when the chemical mechanical polishing is carried out with respect to the wafer W, for the sake of illustration, the polishing is carried out usually after the dressing is completed. Nevertheless, the polishing may be carried out concurrently with the chemical mechanical polishing in the chemical mechanical polishing system 20.

Figure 3:
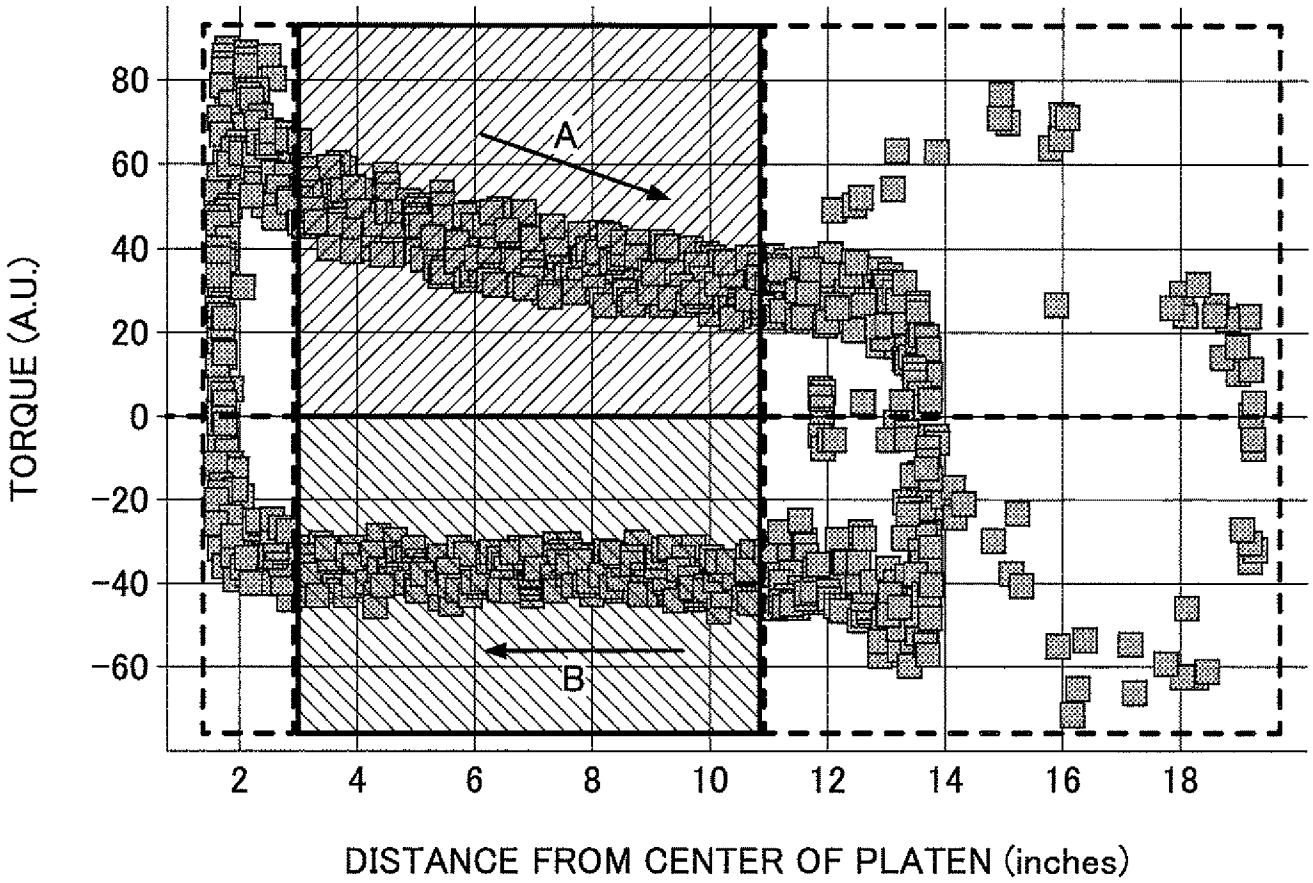
FIG. 3 is a scattering diagram illustrating a relationship between values of the torque obtained in the chemical mechanical polishing apparatus according to the embodiment of the present invention and corresponding positions of the conditioning disk on the polishing pad.

FIG. 3 is a graph illustrating a relationship between values of the torque N obtained in the chemical mechanical polishing apparatus 20A and the corresponding positions of the conditioning disk 23 on the polishing pad 21 (specifically the corresponding distances of the conditioning disk 23 along the radius direction of the platen 21 from the center of the platen 21). In FIG. 3, the vertical axis represents the torque N in an arbitrary unit, and a horizontal axis represents the distance in a unit of inches from the center of the platen 21. In addition, an arrow A in FIG. 3 indicates a case where the conditioning pad 21 is scanned on the polishing pad 21P from the center to the circumference of the platen 21 by the arm 23A, and an arrow B indicates a case where the conditioning pad 21 is scanned on the polishing pad 21P from the circumference to the center of the platen 21 by the arm 23A.

In the example of FIG. 3, the conditioning disk 23 is composed of a metal disk having a diameter of 4 inches and the diamond abrasive grains embedded on the metal disk with a resin layer, and scanned on the polishing pad 21P within a radius distance range of 1 to 14 inches from the center of the platen 21. Incidentally, when the radius distance range exceeds 14 inches, the conditioning disk 23 is located outside of the platen 21 and the polishing pad 21P. A radius distance of 19 inches corresponds to the home position illustrated in FIG. 2.

Referring to FIG. 3, when the rotational direction of the platen 21 is in agreement with the rotational direction of the conditioning disk 23, a positive value of the torque N is detected if the arm 23A is moved from the center to the circumference of the platen 21 as illustrated by the arrow A in FIG. 3, and a negative value of the torque N is detected if the arm 23A moved from the circumference to the center of the platen 21 as illustrated by the arrow B. In FIG. 3, each rectangle indicates the position in a radius direction of the conditioning disk 23 and the torque N measured at the position by torque measurement part 23D of the bearing part 23B.

FIG. 3 illustrates a result of a relatively appropriately performed dressing. Namely, a fluctuation range Y of the torques N is relatively small and absolute values of the detected torques N are relatively large, in both cases where the arm 23A is moved from the center to the circumference of the platen 21 and from the circumference to the center of the platen 21. In addition, there exists a relatively large difference in the values of the torque N between the case where the arm 23A is moved from the center to the circumference of the platen 21 and the case where the arm 23A is moved from the circumference to the center of the platen 21.

Incidentally, in FIG. 3, the arm 23A, which is once moved from the center of the platen 21 to a position 13 to 14 inches away from the center substantially along the radius direction of the platen 21, is moved back toward the center of the platen 21, and the arm 23A, which is once moved from the circumference of the platen 21 to a position 2 to 3 inches away from the center substantially along the radius direction of the platen 21, is moved back toward the circumference of the platen 21. When the arm 23A changes its directions of movement, the detected values of the torque N are largely changed from a positive value to a negative value, or from a negative value to a positive value.

Figure 4:
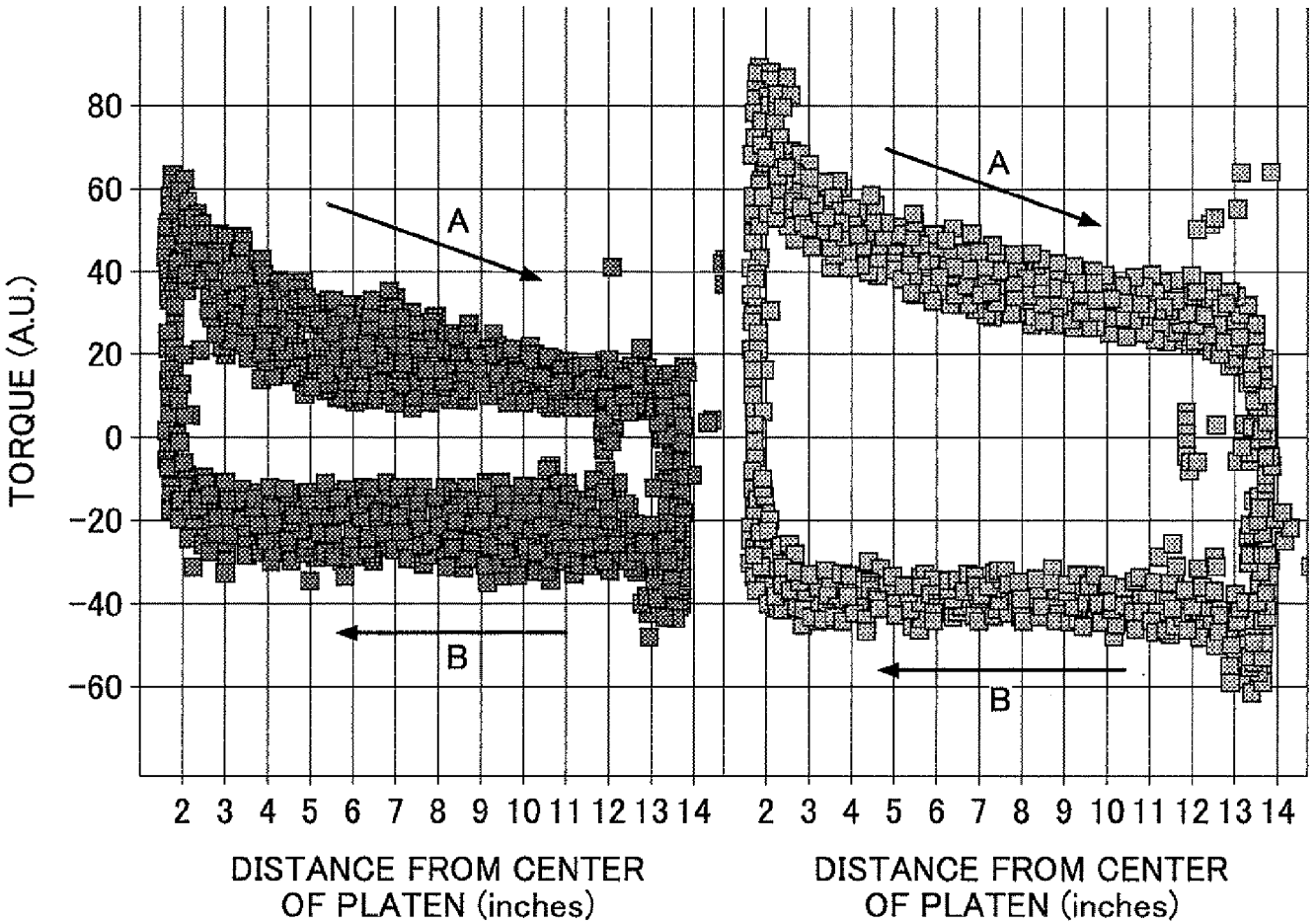
FIG. 4 is a scattering diagram comparably illustrating cases where the arm is in a normal condition and where the arm is in an abnormal condition.

FIG. 4 comparatively illustrates a result of a relatively appropriately performed dressing (on the right hand side) and an inappropriately performed dressing (on the left hand side).

Referring to FIG. 4, the fluctuation ranges of the torques N are reduced and the absolute values of the detected torques N are large regardless of the directions of the movement of the arm 23A with respect to the platen 21, and there is a large difference between the torques N detected when the arm 23A is moved from the center to the circumference of the platen 21 and when the arm 23A is moved from the circumference to the center of the platen 21, in the case of an appropriately performed dressing, as illustrated on the right hand side of FIG. 4. It is thought that such a result is obtained because the conditioning disk 23 stably and firmly contacts the polishing pad 21P, thereby assuredly scraping the surface of the polishing pad 21P.

On the other hand, in the result illustrated on the left hand side of FIG. 4, the torques N vary in a wider range, and absolute values of the detected torques N are reduced, and thus the changes of the torques N are relatively small when the arm 23A changes its directions of movement. This result may be obtained because the conditioning disk 23 does not appropriately act on the polishing pad 21P, and thus insufficiently scrapes the polishing pad 21P.

Figure 5B:
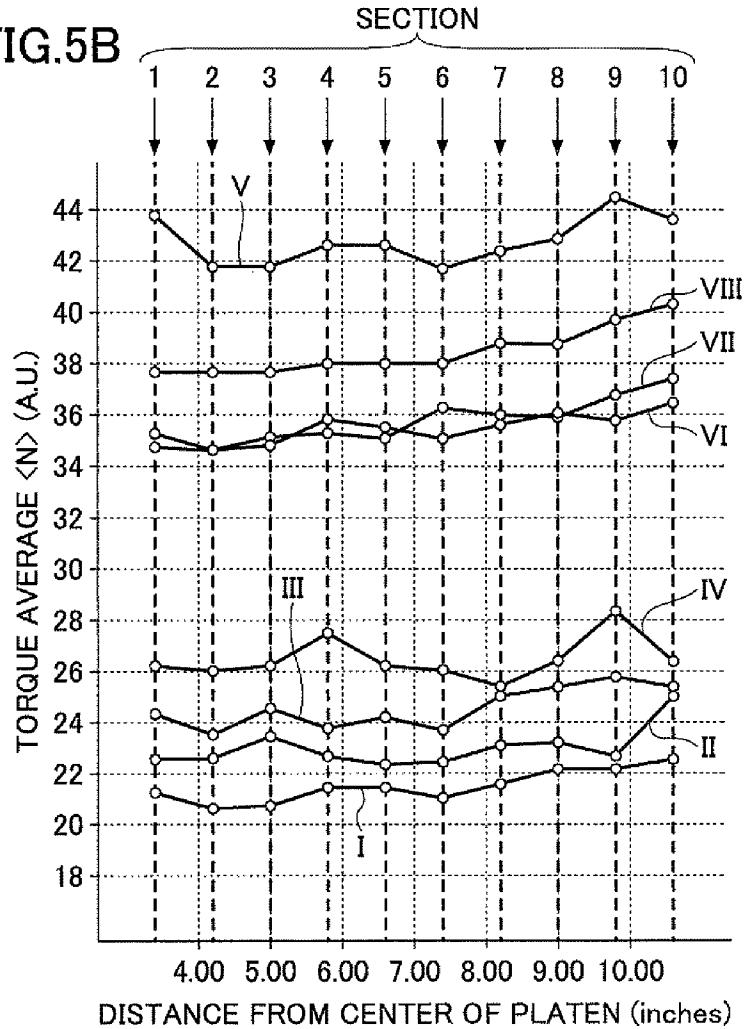
FIG. 5B is another graph illustrating a relationship between an average value of the torques obtained at the plural positions and a fluctuation range of the torques.
Figure 5A:
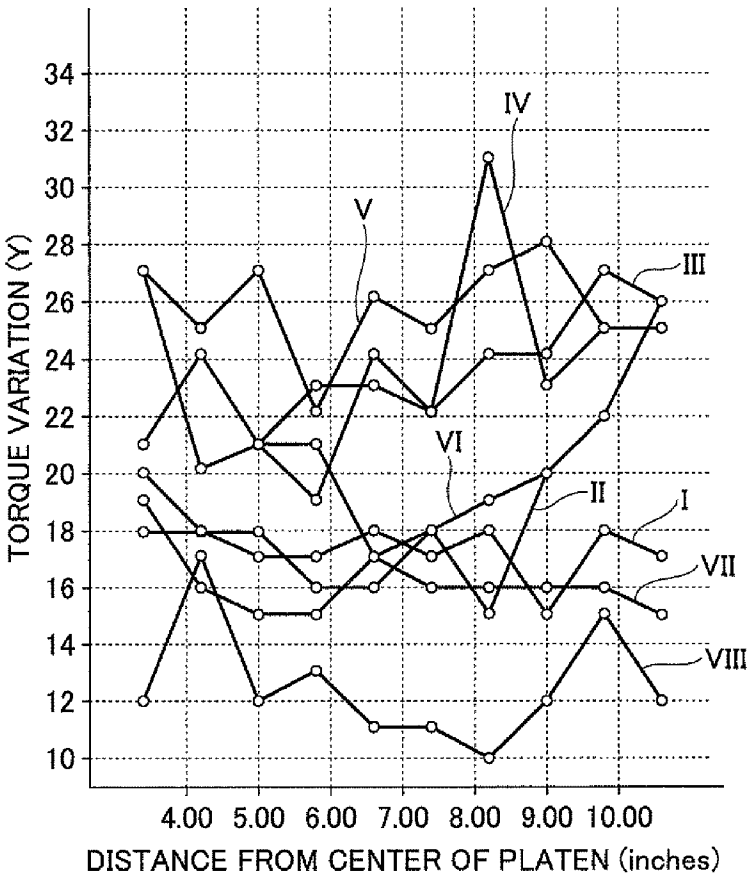
FIG. 5A is a graph illustrating a relationship between an average value of the torques obtained at the plural positions and a fluctuation range of the torques.

FIGS. 5A and 5B illustrate an average value of the torque N and a fluctuation range Y of the torques N in relation to the radius distance (in inches) of the conditioning disk 23 measured from the center of the platen 21. This result has been obtained during the dressing process carried out in the chemical mechanical polishing apparatus 20A where the arm 23A and the bearing part 23B are in various conditions. In addition, as the polishing pad 21P, a CMP Pad IC1510™, available from Nitta Haas Incorporated (Osaka, Japan) was used. The conditioning disk 23 used in this experiment was a metal disk having a diameter of 4 inches and diamond abrasive grains having particle sizes from #80 to #100 embedded on the metal disk. Moreover, the platen 21 and the conditioning disk 23 were rotated along the same direction at rotational speeds of 40 to 80 rotations per revolution (rpm) and 80 to 110 rpm, respectively. The conditioning disk 23 was pressed onto the polishing pad 21P at a predetermined pressure in a range of 6 to 11 lbf.

Incidentally, the average value of the torques N and the fluctuation range Y of the torques N are obtained for a range of the radial position of the arm 23A, the range excluding ranges of 0 to 3 inches and 11 to 15 inches that include turnup positions of the arm 23A, where the values of the torques N change from positive to negative, or negative to positive.

In addition, an area from 3 to 11 inches of the surface of the polishing pad 21P from the center of the polishing pad 21P was divided, in a similar manner as illustrated in FIG. 2, into toroidal sections 1 to 10, each of which has a radial width of 0.8 inches. The average value of the torques N and the fluctuation range Y of the torques N are obtained for each of the sections, are plotted in FIGS. 5A and 5B, respectively. In FIGS. 5A and 5B, a horizontal axis represents the radial distance from the 3 inch position through the 11 inch position.

Referring to a curve I in FIG. 5B, the average value <N> of the torques N is smaller than any other curve in each of the sections 1 to 10, which indicates that sufficient torque is not applied to the arm 23A. Therefore, it is expected that the polishing pad 21P is not appropriately dressed in the example of the curve I. In addition, referring to FIG. 5A, the fluctuation range Y of the torques N is relatively small, which may result from the generally small torques N.

Referring to a curve II in FIG. 5B, the average value <N> of the torques N is relatively small, although larger compared to the curve I, in each of the sections 1 to 10, which may indicate that sufficient torque is not applied to the arm 23A. In addition, referring to FIG. 5B, the fluctuation range Y of the torques N becomes relatively larger, which may suggest uneven dressing.

In addition, the average value <N> of the torques in the curve III, while being larger than that of the curve II in every section, is still relatively small as illustrated in FIG. 5B, which may suggest that the torque N applied to the arm 23A is not sufficient. Moreover, the fluctuation range largely varies section to section as illustrated in FIG. 5A. It is thought that the conditioning pad 23 bounds from the polishing pad 21P while being scanned on the polishing pad 21P (stick-slip phenomenon).

Similarly, the average value <N> of the torques in the curve IV, while being larger than that in the curve II in every section, is still relatively small as illustrated in FIG. 5B, which may suggest that the torque N applied to the arm 23A is not sufficient. In addition, the fluctuation range Y of the torques largely varies section to section as illustrated in FIG. 5A. It is thought that the conditioning pad 23 bounds from the polishing pad 21P while being scanned on the polishing pad 21P.

Furthermore, while the average value <N> of the torques in the curve V is larger than those in any other curve in every section as illustrated in FIG. 5B, the fluctuation range Y of the torques largely varies section to section as illustrated in FIG. 5A. This may suggest that uniform dressing is not carried out.

On the other hand, the average value <N> of the torques in each section in the curve VI is larger than that in the curves I through IV and the fluctuation range Y of the torques in each section is relatively small. From these results, it is expected that uniform dressing is efficiently carried out in the case of the curve VI.

In addition, the average value <N> of the torques in each section in the curve VII is as large as that in the curve VI and the fluctuation range Y of the torques is further reduced compared to that in the curve VI. Therefore, it is expected that improved uniform dressing is efficiently carried out in the case of the curve VII.

Moreover, the average value <N> of the torques in all the sections 1 to 10 in the curve VIII is larger than that in the curve VII and the fluctuation range Y of the torques N is reduced compared to that in the curve VII in all the sections 1 to 10. Therefore, it is expected that more improved uniform dressing is more efficiently carried out in the case of the curve VIII.

In order to confirm the above expectations, the inventor of the present invention carried out an experiment where a thermal oxide film formed on a silicon wafer was polished after the dressing processes carried out under various conditions, which correspond to the curves I to VIII. Specifically, a 300 mm silicon wafer having a 120 nm thick thermal oxide film thereon was prepared as the wafer W, and held by the polishing head 22 in this experiment. The thermal oxide film was polished for 60 to 120 sec with slurry suitable for polishing an oxide film dispensed to the polishing pad 21P at a dispense rate of 200 ml/min. In this polishing, a rotational speed of the polishing head 22 was in a range of 40 to 80 rpm and the polishing pad 21P was pressed onto the polishing pad 21P at a pressure range of 3 to 8 psi.

Figure 6:
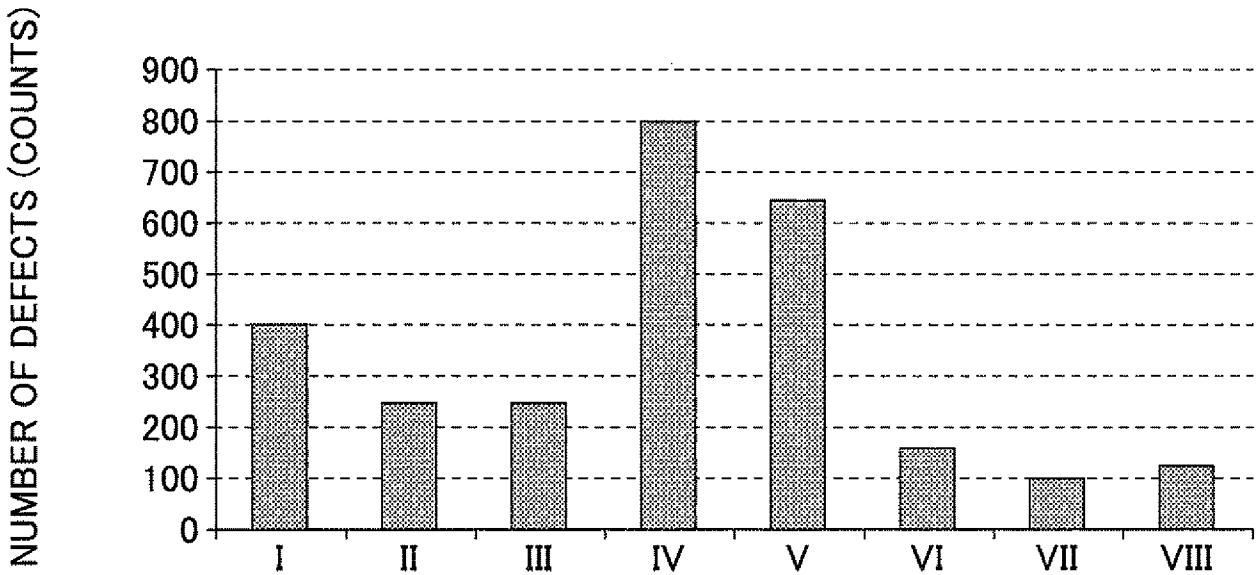
FIG. 6 is a histogram illustrating the number of defects observed on wafers that are chemically mechanically polished after the polishing pad is dressed under various conditions.

FIG. 6 is a graph illustrating the number of defects observed over the silicon wafer polished in this experiment. The defects were observed by the defect detection apparatus 20C. In the graph, a vertical axis represents the number of defects, and a horizontal axis represents the dressing conditions corresponding to the curves I to VIII of FIGS. 5A and 5B.

Referring to FIG. 6, assuming that the number of defects per silicon wafer is restricted to 200 counts, the silicon wafers subject to the polishing after the dressing processes are carried out under the dressing conditions corresponding to the curves VI to VIII are satisfied with the restriction, and the remaining silicon wafers are not satisfied with the restriction. These results are thought to confirm that when a relatively large torque N is applied, the result is a relatively small fluctuation to the arm 23A and thus the surface of the polishing pad 21P is efficiently uniformly scraped by the conditioning disk 23 under the dressing conditions corresponding to the curves I to VIII. When a relatively small torque N or a large but unstable torque N is applied to the arm 23A, the result is that a non-uniform dressing is carried out under the dressing conditions corresponding to the curves I to V.

Figure 7:
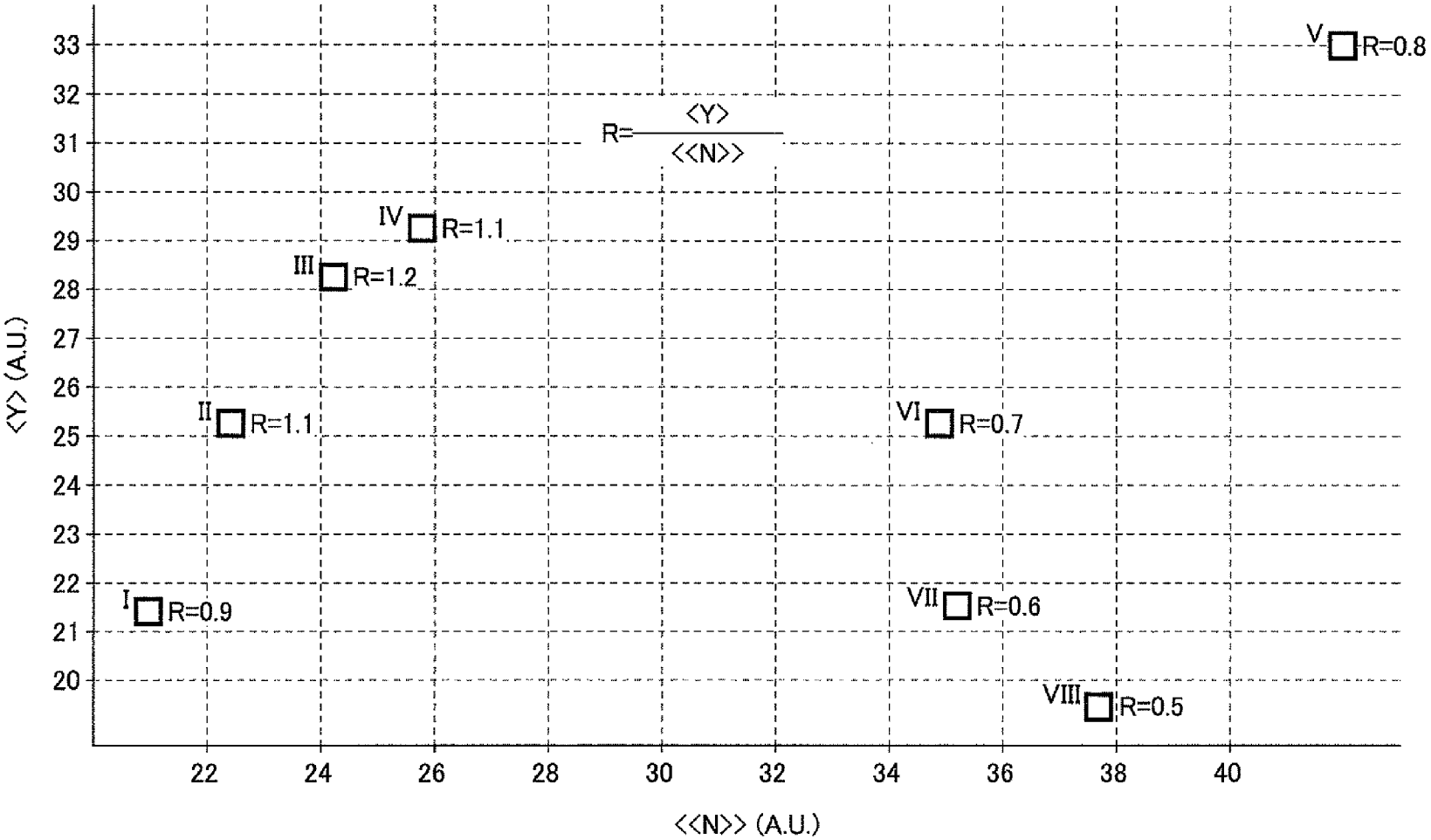
FIG. 7 is a scattering diagram obtained by statistically processing data of FIG. 5.

FIG. 7 is a scattering diagram where an average fluctuation range <Y>, which is obtained by averaging the fluctuation ranges of the torques N in the corresponding sections 1 to 10, is plotted against a double average value <<N>>, which is obtained by averaging the average values <N> of the torques N in the corresponding sections 1 to 10. In FIG. 7, a vertical axis represents the average fluctuation range <Y>, and a horizontal axis represents the double average value <<N>>.

Referring to FIG. 7, the average fluctuation ranges <Y> and the double average values <<N>> of the torques N corresponding to the curves VI to VIII (FIGS. 5A and 5B) are plotted in a lower right area of the diagram. This indicates that the average fluctuation range <Y> is relatively small and the double average value <<N>> is relatively large. On the other hand, the average fluctuation ranges <Y> and the double average values <<N>> of the torques N corresponding to the curves I to IV are plotted in a left hand area of the diagram. In addition, the average fluctuation range <Y> and the double average value <<N>> of the torques N corresponding to the curve V is plotted in a higher right area of the diagram, which indicates that the average fluctuation range <Y> of the torque N is large while the average value <Y> of the torque N is small in the case of the curve V.

In FIG. 7, a ratio R of the average fluctuation range <Y> in relation to the double average value <<N>>, namely, R=<Y>/<<N>>, is obtained for each of the plots. As written in FIG. 7, the ratios R for the plots corresponding to the curves VI, VII, and VIII are 0.7, 0.6, and 0.5, respectively. These ratios R are smaller than the ratios R for the plots corresponding to the curves I to V of 0.9, 1.1, 1.2, 1.1, and 0.8, respectively. Therefore, when the dressing process is carried out under the dressing conditions where the ratio R is smaller than 0.8, or preferably is 0.7 or smaller, polishing defects can be reduced in the polishing process carried out following the dressing process.

Incidentally, the torque N is expressed in an arbitrary unit in the above explanation, the fluctuation range Y of the torque N and the average value <N> of the torque N, or the average value <Y> of the fluctuation range Y of the torque N and the double average value <<N>> of the torque N may vary depending on the unit used. However, because the ratio R is expressed as a unitless value, the ratio R does not vary depending on the unit used.

As stated above, in this embodiment, because the torque N applied to the arm 23A that holds the conditioning disk 23 is obtained at the time of dressing the polishing pad 21P, and the dressing process is evaluated based on the average value <N> of the torque N and the fluctuation range Y of the torque N, highly reliable evaluation is achieved compared to where the evaluation is carried out based only on the average value <N> of the torque N or the fluctuation range Y. Therefore, unnecessary or untimely maintenance can be avoided. Namely, a state or condition of the arm that holds the conditioning disk is observed by not only an average value of the torques that are applied to the arm and measured at plural positions of the arm but also a fluctuation range of the torques. Therefore, when the conditioning disk is non-uniformly pressed to the polishing pad while the sufficient torque is applied, such state can be detected, thereby finding an appropriate timing of maintenance of the arm.

On the other hand, when only the fluctuation range Y of the torques N is monitored, which is disclosed in Japanese Laid-Open Patent Publication No. 2005-22028, inappropriate dressing corresponding to the curves I to III cannot be detected, even if inappropriate dressing corresponding to the curves IV and V is detected. In addition, when only the average value <N> or the double average value <<N>> is monitored, inappropriate dressing corresponding to the curve V cannot be detected, even if inappropriate dressing corresponding to the curves I to IV are detected. In these cases, a problem of the inappropriate dressing can only be found after the polishing process is completed, and it is difficult to find that the problem is caused from the arm 23A and the bearing part 23B, so that unnecessary or untimely maintenance may be carried out.

Figure 8:
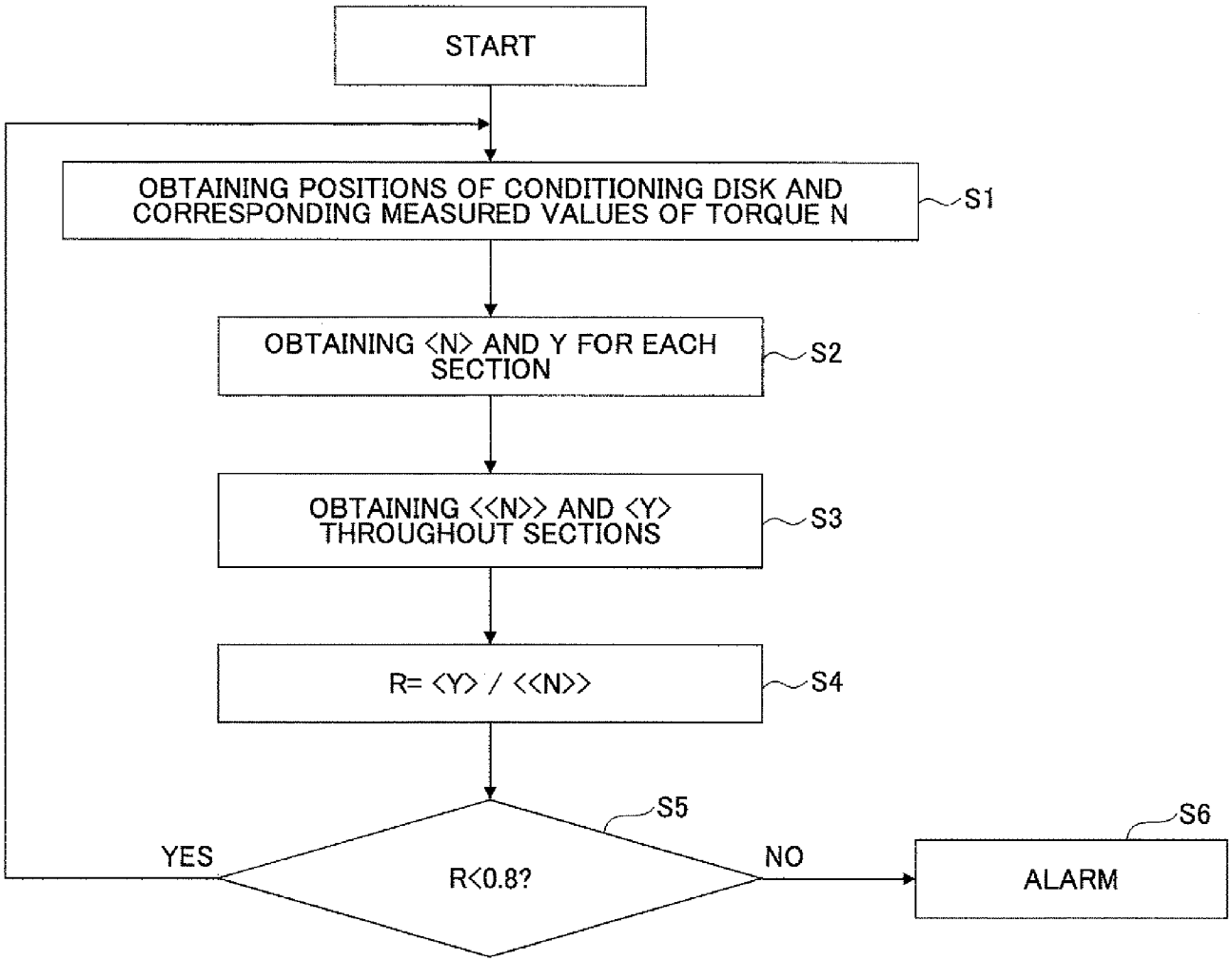
FIG. 8 is a flowchart illustrating a data processing carried out in the chemical mechanical polishing system of FIG. 1.

FIG. 8 is a flowchart illustrating a statistical process carried out to obtain the scattering diagram illustrated in FIG. 7 in the data processing apparatus 20B (FIG. 1).

Referring to FIG. 8, information regarding a position of the conditioning disk 23 along the radial direction from the center of the platen 21 and the torque N applied to the arm 23A is obtained by the torque measurement part 23D provided in the bearing part 23B at Step S1. Next, the average value <N> of the torque N and the fluctuation range Y of the torque N is obtained from the information in each of the sections 1 to 10 at Step S2.

Then, the double average value <<N>> of the torque N is obtained by averaging the double average value <N> of the torque N in each of the sections 1 to 10, and the average value <Y> of the fluctuation range Y is obtained, at Step S3.

Next, the ratio R is obtained based on an expression R=<Y>/<<N>> from the average value <Y> of the fluctuation range Y and the double average value <<N>> of the torque N so obtained, at Step S4. Then, it is determined whether the ratio R is less than 0.8 at Step S5.

When the ratio R is less than 0.8 (Step S5: YES), the dressing is appropriately carried out, and the procedure returns to Step S1. On the other, when the ratio R is 0.8 or greater (Step S5: NO), it is determined that the dressing is not appropriately carried out and an alarm is emitted thereby informing that maintenance of the arm 23A and/or the bearing part 23B is required.

Figure 9:
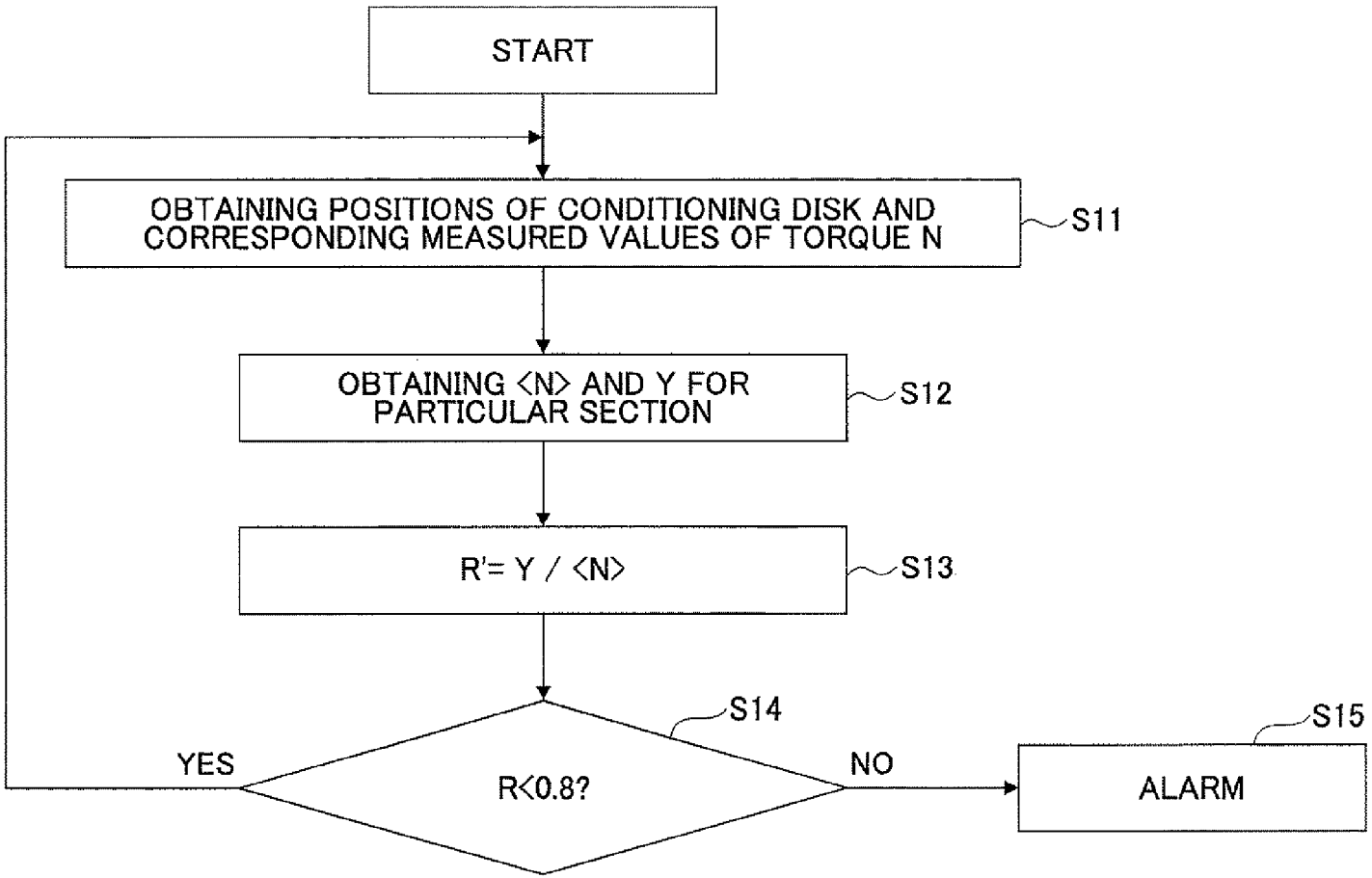
FIG. 9 is a flowchart illustrating an altered example of the data processing illustrated in FIG. 8.

Next, alteration of the statistical process is explained with reference to FIG. 9. In a flowchart illustrated in FIG. 9, the torques N are obtained in corresponding positions of the conditioning disk 23 along the radial direction of the platen 21 at Step S11, in the same manner as Step S1 in the flowchart of FIG. 8. Then, the torques N obtained in a particular section are averaged to obtain the average value <N> of the torques N, and the fluctuation range Y of the torques N in the particular section is obtained at Step S12. Next, a ratio R' of the fluctuation range Y in relation to the average value <N> of the torques N, namely, R'=Y/<N> is obtained at Step S13.

Then, it is determined whether the ratio R' is smaller than a predetermined value, for example, 0.8 at Step S14. When the ratio R' is smaller than the predetermined value (Step S14: YES), the chemical mechanical polishing apparatus 20A is released to the polishing process. On the other hand, when the ratio R' is the predetermined value or larger (Step S14: NO), an alarm is emitted thereby informing that maintenance of the arm 23A and/or the bearing part 23B is required.

Incidentally, the particular section of the polishing pad 21P in this example may be chosen based on accumulated data as a section from which ratio R' obtained can be used as a repeatable, reliable indicator. In addition, the particular section may be determined as the entire area from the section 1 through the section 10 in this example. Moreover, the predetermined value in this example may be determined in a similar manner that a standard value (less than 0.8, or 0.7 or less) for the ratio R is determined, as explained with reference to FIG. 7.

Figure 10:
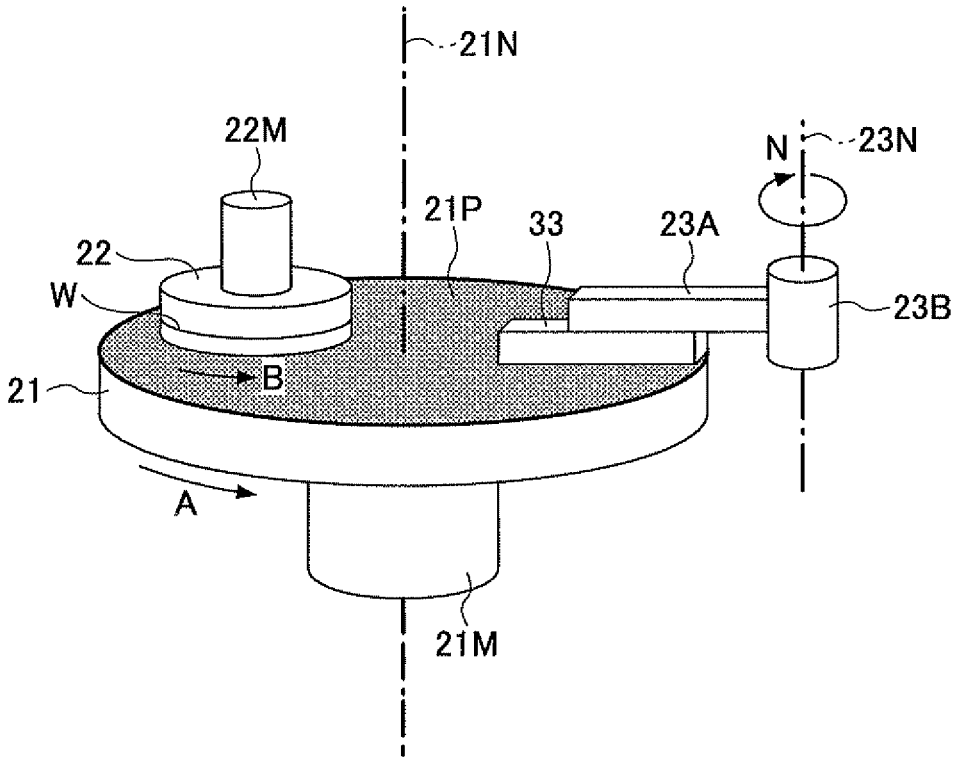
FIG. 10 is a perspective view of an altered example of the chemical mechanical polishing system.

Although the conditioning disk 23, which is rotated by the motor 23M thereby to polish the polishing pad 21P, is used in the above embodiment, an embodiment according to the present invention is not limited to use of the conditioning disk 23. For example, a conditioning brush 33 illustrated in FIG. 10 may be used instead of the conditioning disk 23. In FIG. 10, the same or corresponding reference symbols are given to the parts, members, or components that are the same as those explained above, and redundant explanations are omitted.

While a semiconductor device is taken as an example to explain the above embodiment, the embodiment is applicable to fabricating electric devices other than the semiconductor device.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present inventions have been described in detail, it should be understood that the various changes, substitutions, and alterations could be made hereto without departing from the spirit and scope of the invention.

What is claimed is:

1. A method of fabricating a semiconductor device comprising:

dressing a surface of a polishing pad using a conditioning disk held by an arm while rotating a platen that holds the polishing pad in a chemical mechanical polishing apparatus, wherein the dressing is performed by pressing the conditioning disk to the polishing pad, and rotating the arm around a rotational axis of the arm thereby to move the conditioning disk substantially along a radial direction of the platen between a center part and a circumferential part of the platen, and wherein torque N applied to the arm is measured at plural positions of the conditioning disk along the substantial radial direction during the dressing, and it is determined whether maintenance to the arm is necessary in accordance with an average value <N> of the measured torques N and a fluctuation range Y of the measured torques N, wherein plural sections divided along the radial radius direction of the platen are set on the surface of the polishing pad, and the plural positions in each of which the torque N is measured are distributed throughout the plural sections, wherein the average value <N> of the torques N and the fluctuation range Y of the torques N are obtained in each of the plural sections, wherein a double average value <<N>> is obtained by averaging the average values <N>, each of which is obtained in each of the plural sections, and an average value <Y> is obtained by averaging the fluctuation ranges Y, each of which is obtained in each of the plural sections, and wherein it is determined that the maintenance to the arm is necessary when a ratio of the average value <Y> with respect to the double average value <<N>> exceeds a first value.

2. The method of fabricating a semiconductor device according to claim 1, wherein plural sections divided along the radial direction of the platen are set on the surface of the polishing pad, and the plural positions in each of which the torque N is measured are included in one of the plural sections, and wherein it is determined that the maintenance to the arm is necessary when a ratio of the fluctuation range Y with respect to the average value <N> of the torque N exceeds a first value.

3. The method of fabricating a semiconductor device according to claim 1, wherein the plural positions are chosen from an area on the surface of the polishing pad, the area excluding a region where the arm reverses movement directions thereof.

4. The method of fabricating a semiconductor device according to claim 1, further comprising chemical mechanical polishing performed with respect to a wafer to be polished on the polishing pad after the dressing.

5. The method of fabricating a semiconductor device according to claim 1, further comprising chemical mechanical polishing performed with respect to a wafer to be polished on the polishing pad after the dressing.

6. The method of fabricating a semiconductor device according to claim 5, wherein the first value is 0.8 or less when the chemical mechanical polishing is performed to a silicon oxide film on a wafer.

* * * * *